US005707265A

United States Patent [19]

Fowler et al.

[11] Patent Number: 5,707,265

[45] Date of Patent: Jan. 13, 1998

[54] STREAMLINED BUOYANCY PACKAGE FOR SUBSURFACE MOORINGS

[75] Inventors: George A. Fowler; James M. Hamilton, both of Nova Scotia, Canada

[73] Assignee: Her Majesty in right of Canada as represented by the Department of Fisheries and Oceans, Ottawa, Canada

[21] Appl. No.: 745,915

[22] Filed: Nov. 8, 1996

[51] Int. Cl.[6] ..... B63B 22/18

[52] U.S. Cl. ..... 441/23; 441/1; 441/133

[58] Field of Search ..... 114/242, 244, 114/243, 245, 230, 293; 441/1, 3, 21, 23, 6, 133

[56] References Cited

U.S. PATENT DOCUMENTS 3,590,635 7/1971 Duing ..... 441/23

5,249,997 10/1993 Nance ..... 441/1

5,410,979 5/1995 Allen et al. ..... 114/243

5,443,408 8/1995 Kimball ..... 441/22

*Primary Examiner*—Ed L. Swinehart

*Attorney, Agent, or Firm*—Ronald G. Bitner

[57] ABSTRACT

A buoyancy package for subsurface instrumented moorings with reduced drag and increased stability is provided with the use of spherical buoyant members enclosed in a pivotally connected streamlined housing. The use of a spherical buoyant member provides a buoyant member capable of withstanding high pressures for deep water applications, and in one embodiment provides a convenient structure for providing a pivot with respect to the housing.

5 Claims, 3 Drawing Sheets

STREAMLINED BUOYANCY PACKAGE FOR SUBSURFACE MOORINGS

BACKGROUND OF THE INVENTION

1. Field of the Invention

This invention relates to a streamlined buoyancy package for subsurface instrumented moorings.

2. Description of the Prior Art

Conventional instrumented moorings for oceanographic studies, such as current measurement, include a line held taut by a main float with instruments for making measurements distributed along the line. Since the instruments and mooring line are normally heavier than water, additional buoyancy is required to maintain the line tension and also to minimize instrument excursions and inclinations in higher currents. Spherical buoyancy elements are typically used to provide this in-line buoyancy. In water depths of less than 200 m, hollow plastic balls are used to provide buoyancy, while in deeper water, hollow glass balls enclosed for protection are widely used. In both of these cases the buoyancy is not streamlined.

The present moorings are subjected to considerable drag and vortex shedding motion due to water currents. The buoyancy components are the main source of this type of motion. Drag on the buoyancy components results in horizontal displacement in ocean currents and consequently produces inclinations of the line and vertical displacements of the instruments attached to it.

Spheres used as in-line buoyancy set up mooring vibration which occurs at the Strouhal frequency (f=0.2×velocity/Diameter). Measurements have shown that the amplitude of motion can be as large as 0.5 meters, or 1 meter peak to peak. This motion is perpendicular to the water current. It has been found that the motion causes fluctuations in the measured relative water velocity which degrades current meter measurements.

Attempting to reduce unwanted motion by streamlining the buoyancy components presents a number of obstacles. With non-spherical buoyancy components proper orientation of the components (parallel with the current flow) must be maintained to achieve improved results.

At increasing depths, the design of non-spherical buoyancy components becomes increasingly difficult due to the increased pressures.

SUMMARY OF THE INVENTION

An object of the present invention to provide a streamlined buoyancy package for subsurface moorings to reduce instrument excursions and inclinations in water currents.

Another object of the present invention is to provide a streamlined buoyancy package for subsurface moorings with improved stability in water currents while being capable of withstanding external pressures.

It has been found that buoyancy for subsurface moorings with reduced drag and increased stability can be provided with the use of spherical buoyant members enclosed in a pivoting streamlined housing. The use of a spherical buoyant member provides a buoyant member capable of withstanding high pressures for deep water applications, and in one embodiment provides a convenient means for providing a pivot with respect to the housing.

The present invention provides a buoyancy package for subsurface moorings comprising a plurality of spherical buoyant members; a streamlined housing for enclosing the buoyant members, said housing having openings to allow pressure equalization with the surrounding water; and pivotal connection means for pivotally connecting the housing with a mooring line.

DESCRIPTION OF THE PREFERRED EMBODIMENTS

Figure 1:
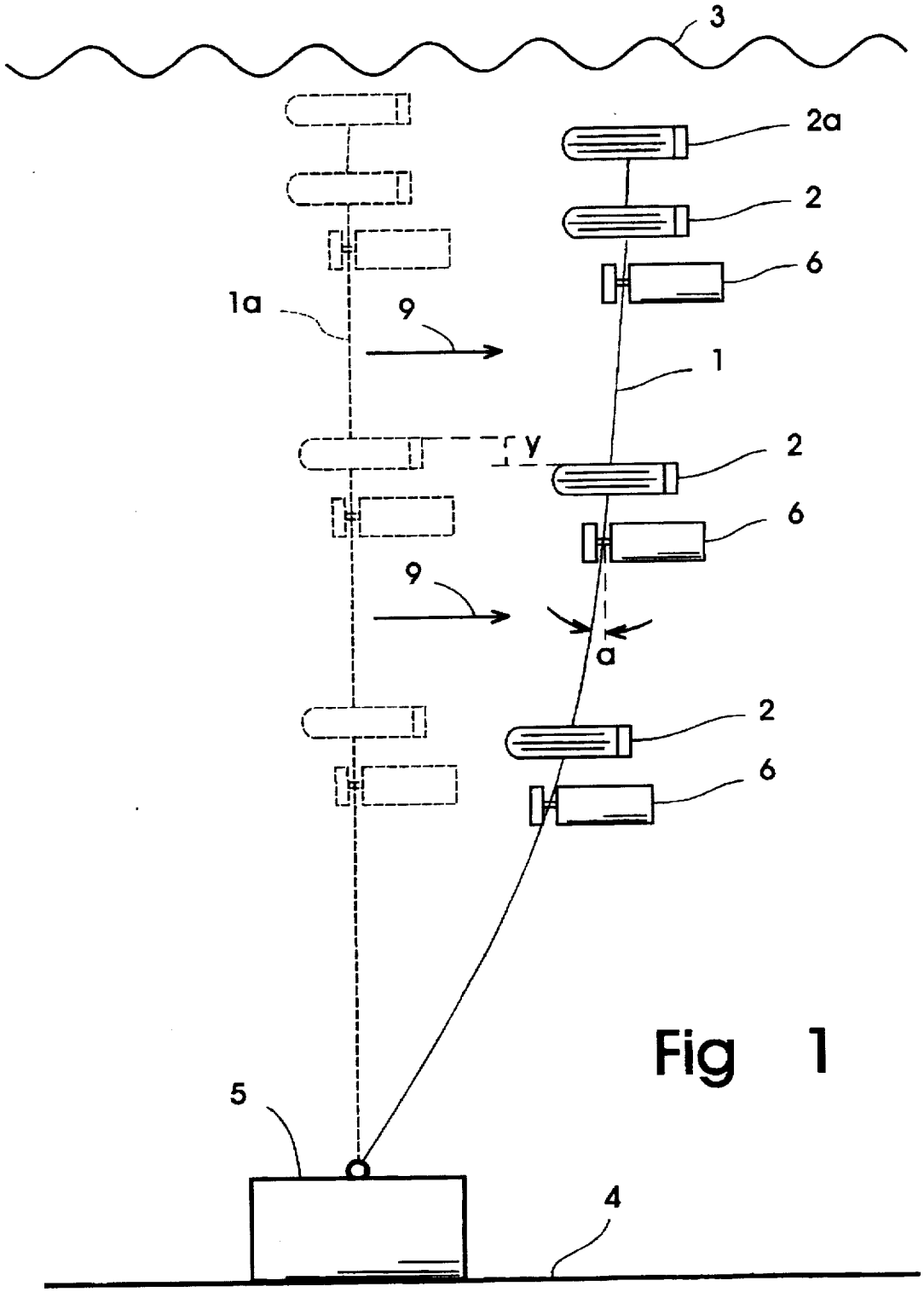
FIG. 1 is a schematic representation of a system incorporating the streamlined buoyancy packages of the present invention.

FIG. 1 shows a typical subsurface mooring arrangement which comprises a line 1 held taut by an upper buoyancy package 2*a* beneath the sea surface 3 and positioned on the sea floor 4 by a suitable anchor 5. Attached to the line 1 are one or more additional buoyancy packages 2 to provide in-line buoyancy.

FIG. 1 also illustrates the vertical displacement y and the inclination angle a of the line, due to ocean currents 9.

Figure 2:
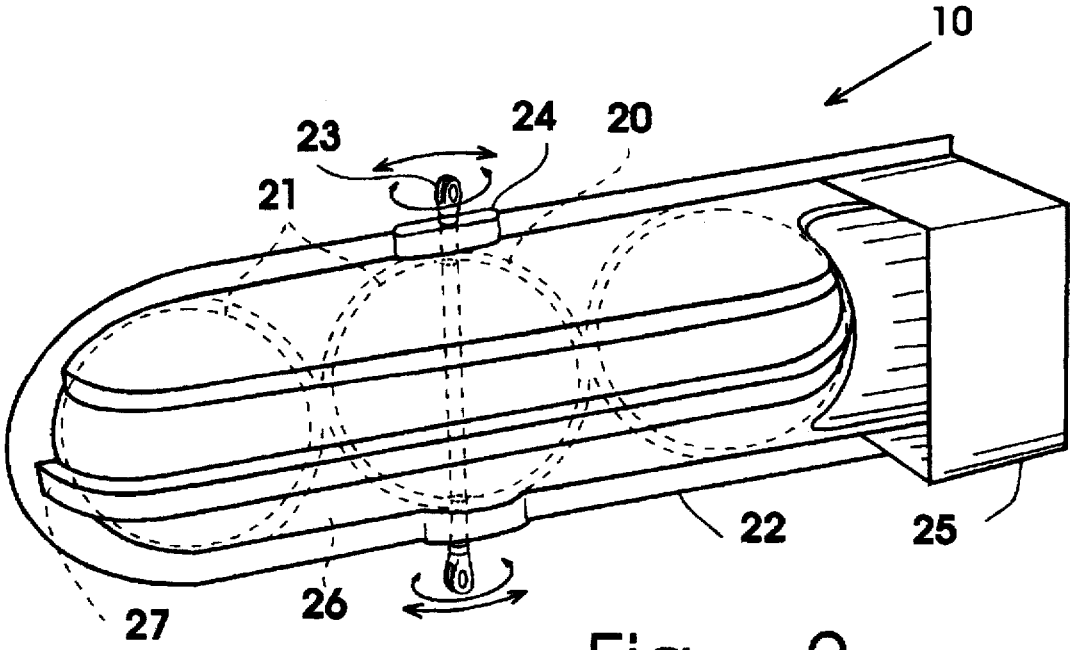
FIG. 2 shows details of one embodiment of a streamlined buoyancy package in accordance with the present invention.

With reference to FIG. 2, which illustrates one embodiment of present invention, each buoyancy package 2 comprises a plurality (three shown) of spherical buoyant members 21 surrounded by a streamlined housing 22. The assembly is attached to the line by means of the tie rod 23.

The housing has suitable openings 24 to allow pressure equalization with the surrounding water to avoid stress on the housing at depths.

The buoyant members 21 are retained in position by suitable bulkhead structure 26.

In the embodiment of FIG. 2, one of the buoyant members 20 is connected to the line by means of tie rod 23. The buoyant member 20 is free to rotate within the housing forming a pivotal connection or swivel to allowing rotation about a vertical axis which is coaxial with a longitudinal axis of the line. The arrangement also allows limited pivoting about a horizontal axis perpendicular to the longitudinal axis of the housing. This is made possible by the elongated opening 24 in the housing 22 which allows longitudinal motion of the end of the tie rod 23. Such pivoting of the housing about a horizontal axis allows the buoyancy member to remain horizontal when the line is inclined from the vertical due to water currents 9, as shown in FIG. 1. Remaining horizontal minimizes the frontal area and hence drag and thereby minimizes inclination that results due to drag.

It will be noted that the buoyant members 21 are arranged horizontally along an axis corresponding with a longitudinal axis of the housing. This arrangement allows a reduced frontal area and hence reduced drag as compared with a single buoyant member of the same volume.

The streamlined housing is connected to the line ahead of the hydrodynamic center to provide that it aligns itself to the flow. A stabilizer 25 facilitates alignment. Ribs 27 improve stability and structural rigidity of the housing.

The embodiment of FIG. 2 is suited for moderate depths and pressures since one of the buoyant members 20 is provided with a through hole that is penetrated by the tie rod 23.

Figure 3:
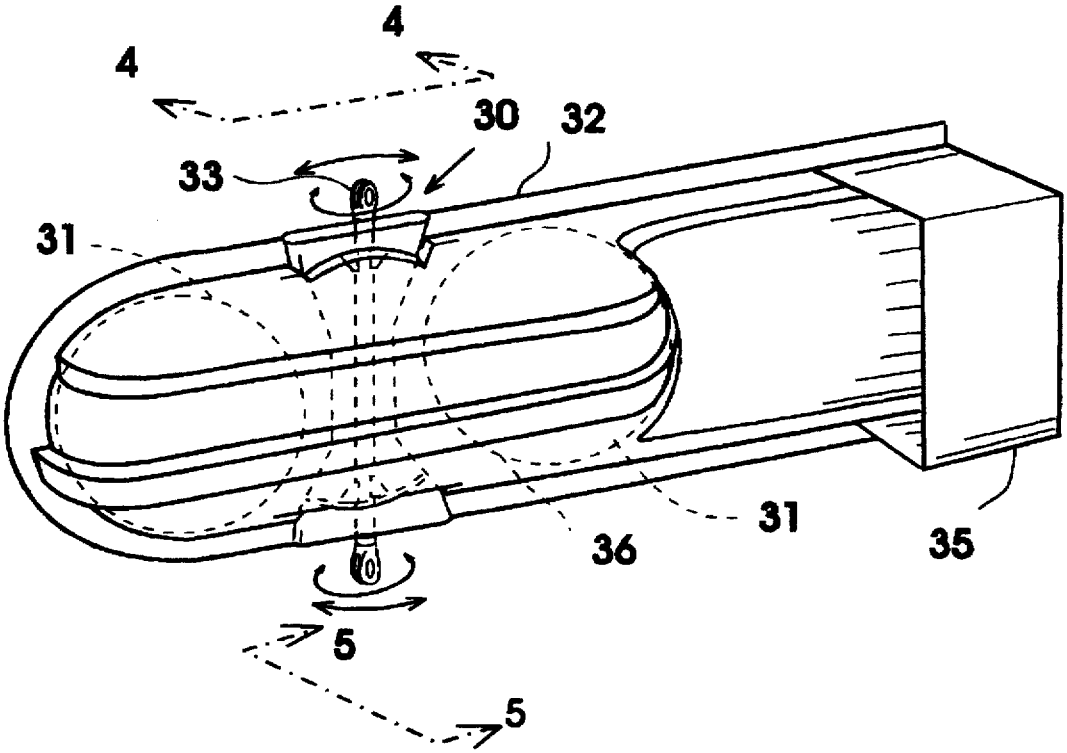
FIG. 3 illustrates a second embodiment of a streamlined buoyancy package in accordance with the present invention.
Figure 5:
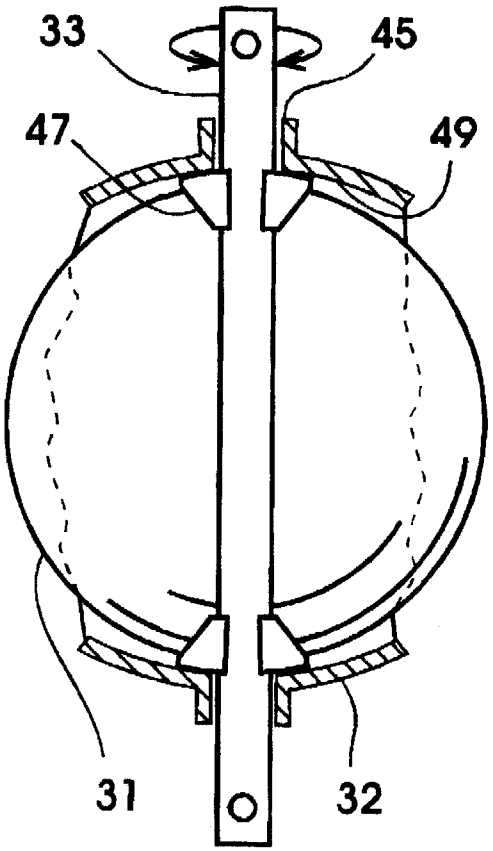
FIG. 5 is a fragmented sectional view taken at 5—5 of FIG. 3 showing details of the pivotal connection between the line tie rod and the housing of the buoyancy package.
Figure 4:
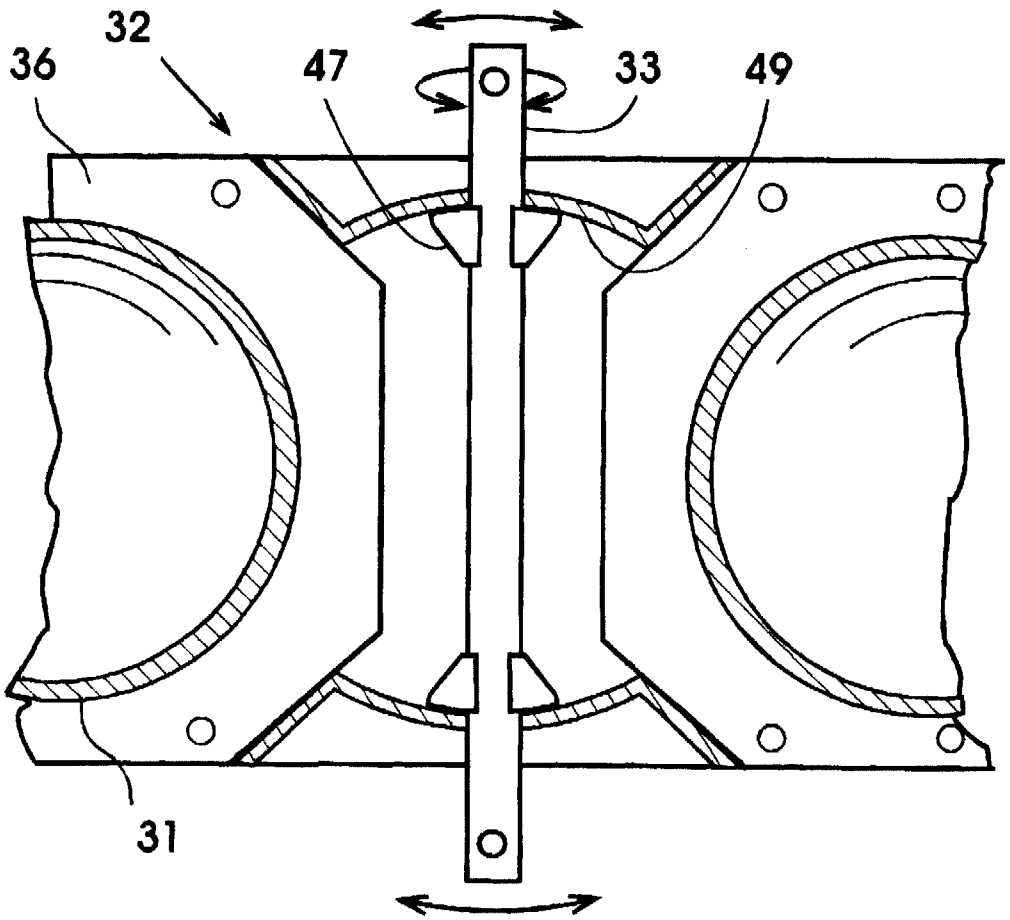
FIG. 4 is a fragmented sectional view taken at 4—4 of FIG. 3 showing details of the pivotal connection between the line tie rod and the housing of the buoyancy package.

FIGS. 3 to 5 illustrate another embodiment of the invention suited for greater depths and pressures. With reference to FIG. 3, the buoyancy package comprises a pair of buoyant members 31, for example glass spheres, surrounded by streamlined housing 32, and separate pivotal connection means 30. As in the embodiment of FIG. 2, the pivotal connection means 30 provides pivoting about both the horizontal and vertical axis.

Details of the pivotal connection means for the embodiment of FIG. 3 are shown in FIGS. 4 and 5.

With reference to FIG. 4 and 5, attached to the tie rod 33 are bearing or follower elements 47 adapted to cooperate with guiding elements attached to, or forming part of the housing 32. The guiding elements include a bearing surface 49 having a curved profile with radius corresponding to that of the follower element 47, and a longitudinal slot 48 (See FIG. 5) at the top and bottom of the housing for confining the lateral motion of the tie rod 33.

As best seen in FIG. 4, the follower 47 and bearing surface 49 cooperate to allow limited pivoting of the tie rod with respect to the housing and thereby allow the housing to remain horizontal when the line is inclined due to ocean currents, as shown in FIG. 1.

The tie rod 33 is free 19 rotate within the slot 45 to allow rotation of the package with respect to the line, to allow the buoyancy package to freely orient itself into the current to minimize drag, and also prevents twisting or "winding-up" of the buoyancy package and line.

Measured instrument displacements on a mooring using the streamlined packages of the present invention were typically 3 to 5 times less than with conventional in-line spherical buoyancy (Viny floats). The reduced motion provided by the present buoyancy package was found to overcome an under-reading problem previously encountered in current meter measurements.

It will be appreciated that various aspects of the buoyancy package may be varied from that shown, such as the number, materials, construction and retention of the buoyancy members, the construction of the housing, and the pivotal connection means. Also, measuring instruments may be placed inside the streamlined housing with the buoyancy members.

What is claimed is:

1. A buoyancy package for subsurface moorings comprising a plurality of substantially spherical buoyant members;

a streamlined housing for enclosing the buoyant members, said housing having openings to allow pressure equalization with the surrounding water;

pivotal connection means for pivotally connecting the housing with a mooring line; and wherein one of the buoyant members has means for attachment with the mooring line and whereby said one buoyant member is rotatably mounted within the housing to allow pivoting of the line relative to the housing.

2. The device of claim 1, wherein the pivotal connection means includes means to allow rotation of the housing about a vertical axis, and means to allow pivoting of the housing about a horizontal axis to allow the package to remain horizontal when the line is inclined from the vertical.

3. The device of claim 1, wherein the buoyant members are arranged horizontally along an axis corresponding with a longitudinal axis of the housing.

4. The device of claim 1, wherein one the buoyant members has means for attachment with a mooring line and whereby said one buoyant member is rotatably mounted within the housing to allow pivoting of the line relative to the housing.

5. The device of claim 1, including means to maintain alignment with water current direction.

* * * * *